US006811493B1

(12) United States Patent
Lee

(10) Patent No.: US 6,811,493 B1
(45) Date of Patent: Nov. 2, 2004

(54) SIDE RING BATON

(76) Inventor: Darrell Tyrone Lee, 1883 US 117 S., Warsaw, NC (US) 28398

( * ) Notice: Subject to any disclaimer, the term of this patent is extended or adjusted under 35 U.S.C. 154(b) by 86 days.

(21) Appl. No.: 10/060,964

(22) Filed: Jan. 29, 2002

Related U.S. Application Data

(60) Provisional application No. 60/264,710, filed on Jan. 30, 2001.

(51) Int. Cl.[7] ..... F41B 15/02

(52) U.S. Cl. ..... 463/47.2; 463/47.6

(58) Field of Search ..... 463/47.2, 47.4, 463/47.6, 47.7; 473/302, 303, 549, 551, 568

(56) References Cited

U.S. PATENT DOCUMENTS 2,226,949 A * 12/1940 Simpson ..... 84/477 B
2,710,190 A * 6/1955 Schimansky ..... 473/206
2,928,678 A * 3/1960 Cutting ..... 473/206
4,697,377 A * 10/1987 Martin ..... 43/23
4,819,137 A * 4/1989 Hamilton ..... 362/102
5,593,159 A * 1/1997 Otake ..... 463/47.2
5,609,175 A * 3/1997 Gerry et al. ..... 135/16
5,863,251 A * 1/1999 Fusco ..... 463/47.2

* cited by examiner

*Primary Examiner*—William M. Pierce
(74) *Attorney, Agent, or Firm*—Yi Li

(57) ABSTRACT

A side ring baton is disclosed. The side ring baton is comprised of an elongated cylindrical shaft with an anterior end and a posterior end, and a side ring having a circular interior, tangentially connected to the elongated shaft near the anterior end of the elongated shaft. The side ring is fixed stationary in a horizontal plane with the elongated shaft. The side ring baton also has a finger fulcrum between the shaft and posterior side of the side ring for rotational acceleration. The side ring baton further has a mini light attached to the finger fulcrum of the baton for providing light in the night.

10 Claims, 1 Drawing Sheet

SIDE RING BATON

REFERENCE TO RELATED APPLICATION

This application corresponds in subject matter to Provisional Application Ser. No. 60/264,710, filed Jan. 30, 2001, which is herein incorporated by reference in its entirety.

FIELD OF THE INVENTION

The present invention relates to a baton, more specifically, relates to a side ring baton serving as a protective device or a weapon in a person to person combat.

BACKGROUND OF THE INVENTION

Although many law enforcement or security personnel often carry fire arms, many of such personnel typically carry non-firing weapons such as a baton. A common type of baton, called a night stick or billy club, is a rigid elongated club made of wood, metal or other sturdy materials. The baton is used either offensively to disarm or subdue an offender, or defensively as a protective device. Typically, to dysfunction an offender, a police officer uses a baton to strike on certain body locations of the offender. Such strikes are forceful, however, it can easily cause permanent damages to an offender.

When a law enforcement or security officer subdues an offender it is desirable to perform the task quickly and effectively so as to eliminate any potential harm to the officer, a victim or any other persons or objects in the vicinity. In the use of reasonable force to subdue the offender it is preferable to perform the task without harming or with minimal harm to the offender. One, effective technique of restraining an offender is to apply force to pressure points of the human body. The use of force at the, pressure points of the human body is common in martial arts and is typically taught to law enforcement officials. Applying force at a pressure point enacts an intense pain with use of little force, and without permanent injury. Such pain typically renders a person incapable of fighting back while the force is applied.

However, a conventional baton is not suitable for such a purpose, because it is bulky in size, rendering it difficult to control for pointing to the bodily pressure points. Furthermore, the large diameter at the ends of the baton has a large contact area with the body, which provides a much less intense pressure on a pressure point comparing to a device having a smaller end.

Furthermore, it is not easy to reposition or redirect conventional batons because of their bulky sizes. However, such a function is frequently required in a person to person combat depending the relative positions between a police officer and an offender. Even further, sometimes, the baton can be dropped off when the officer is under attacks.

Therefore, it is apparent there exists a need for an improved baton which can be conveniently repositioned and controlled by a user, and can be used for effectively applying pressures to pressure points of a human body, and can remain attached to the user during combat.

SUMMARY OF THE INVENTION

In one aspect, the present invention relates to a side ring baton. The side ring baton comprises an elongated shaft with an anterior end, and a posterior end; and a side ring having a circular interior, tangentially connected to the elongated shaft near the anterior end of the elongated shaft, the side ring being fixed stationary in a horizontal plane with the elongated shaft.

In a further embodiment, the side ring baton of the present invention further comprises a finger fulcrum between the elongated shaft and the side ring to assist rotational acceleration of the side ring baton.

In an additional embodiment, the side ring baton of the present invention can further comprise a mini light for providing light in the night. The mini light is attached to the finger fulcrum of the side ring baton, or alternatively attached to the anterior end of the elongated shaft.

It is an object of the present invention to provide an improved baton which can be easily rotated and repositioned through the side ring for user's specific purposes.

It is another object to provide a baton wherein various ends of the baton can be used for effectively applying pressures to pressure points of a human body for disarming an offender.

It is a further object to provide attachment of a baton to the user to assist control of the baton during a combat.

The above and yet other objects of the present invention will become apparent from the hereinafter set forth Detailed Description of the Invention and Claims appended herewith.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
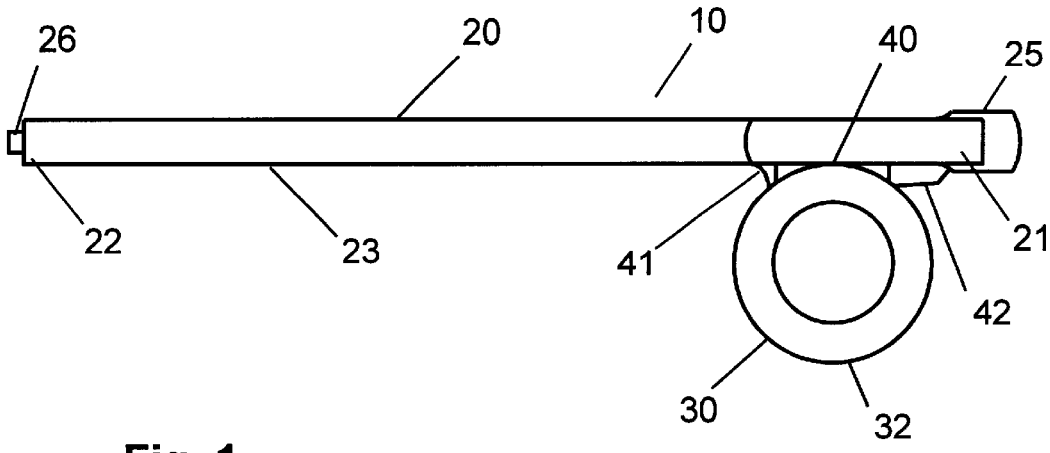
FIG. 1 is a perspective view of a side ring baton of one embodiment of the present invention.

In one embodiment, the present invention relates to a side ring baton. FIG. 1 shows a perspective view of the side ring baton 10 of one embodiment of the present invention. The side ring baton comprises an elongated shaft 20 with an anterior end 21, and a posterior end 22; and a side ring 30 connected to elongated shaft 20 near anterior end 21 of shaft 20. Preferably, elongated shaft 20 is cylindrical. Side ring 30 can be connected to elongated shaft 20 at connection point 40 by welding or other suitable means. The interior of side ring 30 is circular and the exterior of side ring 30 is substantially circular with possible exceptions at connection point 40, wherein the contacting surface with elongated shaft 20 can be flat to increase contact area. When the side ring baton is made by molding, side ring 30 will be formed as an integral part of the baton. Optionally, the connection between side ring 30 and elongated shaft 20 can be further enforced by additional supports 41 and 42.

Distinguished from connection point 40, the portion of elongated shaft 20 between posterior end 22 and connection point 40 is called posterior side, and the portion of elongated shaft 20 between anterior end 21 and connection point 40 is called anterior side. Similarly, the side of side ring 30 facing posterior end 22 of elongated shaft 20 is called posterior side of the side ring, and the side of side ring 30 facing anterior end 22 of shaft 20 is called anterior side of side ring 30. Furthermore, the side of elongated shaft 20 connected to side ring 30 is called exterior side 23, because this side is facing outside toward the offender when the baton is in use, as described in detail hereinafter, and the opposite side of elongated shaft 20 is called interior side. Similarly, the side of side ring 30 opposite connection point 40 is called exterior side of side ring 30, and the extreme point of the exterior side is called exterior end 32.

Elongated cylindrical shaft 20 has a length from about 5.5 inches to 9.0 inches. Side ring 30 has a diameter from about 1.1 inches to about 2.5 inches. The length of posterior side of elongated shaft 20 is from about 1.5 inches to about 2.5 inches. Elongated cylindrical shaft 20 and side ring 30 are made of metals or other hardened materials.

Optionally, the side ring baton can further comprise a surface coating covering side ring 30, and/or anterior end 21 of the side ring baton. The coating provides a smooth surface and enhances ease of use for the user. Suitable examples of the coating include plastic coatings, rubber wraps, or, other suitable materials which provide a smooth surface. An anterior end coating 25 is illustrated in FIG. 1.

When the side ring baton is in use, the index finger of a user is placed into side ring 30 and with hand holding elongated shaft 20 with anterior end 21 toward the top of the fist. The side ring baton can be redirected rapidly by rotating elongated shaft 20 around the user's index finger through rotation of side ring 30. Posterior end 22 and anterior end 21 of elongated shaft 20, and exterior end 32 of side ring 30 can each be used to apply pressure to a pressure point of an offender for the purpose of disarming the offender. Elongated shaft 20 of the side ring baton can also be used for striking, or blocking attacks from an offender.

Additionally, for the purpose of enhancing pain and disarming function of the side ring baton of the present invention, the side ring baton can further comprise a pressure amplifying tip 26 connected to posterior end 22, or also anterior end 21. Pressure amplifying tip 26 can be in a square shape or a semi-spherical shape with a flat end connected to posterior end 22. Alternatively, pressure amplifying tip 26 can be an integral part of elongated shaft 20 if when the side ring baton is produced by molding. Pressure amplifying tip 26 is used to intensify pain when posterior end 22 is pressed onto a pressure point of human body. However, pressure amplifying tip 26 has dull exterior surface, not intended to penetrate human body.

Figure 2:
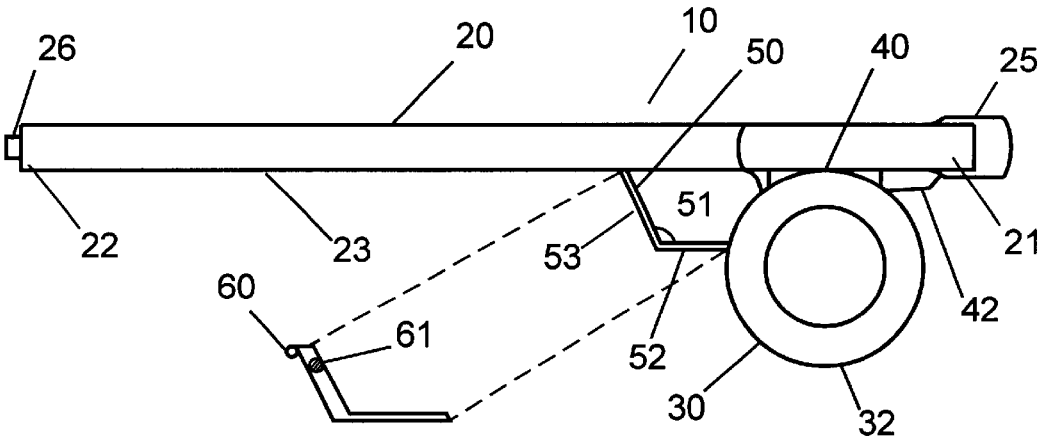
FIG. 2 is a perspective view of a side ring baton with a finger fulcrum of one embodiment of the present invention.

In another embodiment, the baton further comprises a finger fulcrum 50 between elongated shaft 20 and side ring 30, as illustrated in the FIG. 2. Herein finger fulcrum 50 is formed by two bars interconnected in an angle 51, the first bar 52 being connected to the posterior side of side ring 30 and being parallel to elongated shaft 20, and the second bar 53 being connected to posterior side of elongated shaft 20. Preferably, angle 51 is in a range from about 90 degree to about 120 degree. It should be understood that although first bar 52 and second bar 53 are shown as two straight bars in the drawing as an example, a single bar bended in a similar shape, such as when it is made by molding, is also suitable.

Finger fulcrum 50 assists rational acceleration when the user needs to rotate elongated shaft 20. Moreover, finger fulcrum 50 also provides further support of hands when the user applies pressure through exterior end 32 of side ring 30, hence it assists to increase the pressure.

Alternatively, finger fulcrum can also be formed by one straight bar (not shown) connected between posterior side of elongated shaft 20 and side ring 30.

In a further embodiment, a portion of the elongated shaft near the posterior end bends towards the interior side of the elongated shaft, i.e., the opposite direction of the side ring. Preferably, the angle between the bent portion of the elongated shaft and the longitudinal axis of the elongated shaft is in a range from about 110 degree to 130 degree, and the distance from the bending point to the posterior end is from about 6 inches to, about 7 inches. A bent shaft, as described, can further assist the user to apply pressure at the posterior end in certain circumstances. More importantly, a bent shaft has an additional hooking function wherein the baton can be utilized to hook on an offender's arm, leg or the back of the neck to effectively disarm the offender.

In an additional embodiment, the side ring baton can further comprise a mini light for providing light in the night. The light can facilitate searches of a suspect by a police officer. A mini light integrated into the side ring baton of the present invention can reduce numbers of safety devices a person needs to carry in the night, particularly for police officers considering various other devices that police officers have to carry when they are on duty. Preferably, a mini light 60 is attached, or mounted into first bar 52 of finger fulcrum 50, wherein mini light 60 faces posterior side of elongated shaft 20, as shown in FIG. 2. Mini light 60 can be turned on and off by switch 61. A suitable example of mini light is a L.E.D. light commercially available from STREAMLITE Inc., which is powered by a button battery. Alternatively, a mini light can also be attached to or mounted on anterior end 21 of elongated shaft 20.

It is apparent from the above description that the side ring baton of the present invention has several advantages. The side ring provides a rotational mechanism for user to reposition the baton conveniently. For example, as described previously, normally the anterior end of the side ring baton is at the top of the fist. While with a quick 180 degree rotation, the elongated shaft is reversed and the posterior end is positioned to the top of the fist, which provides a more effective attack from the bottom up. Furthermore, the side ring provides an attachment of the baton to the user so that a person in defense can hold on the baton without losing it when under attacks. Moreover, the side ring baton provides additional mechanism than a conventional baton for disarming an offender. With a conventional baton, a person typically uses the shaft of the baton to strike an offender on the head, the shoulders, and the legs. With the side ring baton of the present invention, in addition to striking, the user can also apply intense pressure on pressure points of an offender through various ends of the side ring baton, including posterior and anterior ends of the elongated shaft and exterior end of the side ring. It is apparent that the side ring baton of the present invention is much smaller than conventional batons in size, both in length and diameter of the elongated shaft. Therefore, the small contact points of various ends of the side ring baton can be utilized for applying pressure. Furthermore, to effectively applying pressure over the pressure points of a human requires positional accuracy and stability of the baton. These are supported by the controllability of a small baton and further supported by the attachment of the baton to the user's hand through the side ring.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

I claim:

1. A side ring baton comprising:

(a) an elongated shaft with an anterior end, and a posterior end;

(b) a side ring having a circular interior, tangentially connected to said elongated shaft near said anterior end of said elongated shaft, said side ring being fixed stationary in a horizontal plane with said elongated shaft; and (c) a finger fulcrum between said elongated shaft and said side ring, wherein said finger fulcrum is formed by two straight bars interconnected in an angle, a first bar being connected to a posterior side of said side ring and being parallel to said elongated shaft, and a second bar being connected to a posterior side of said elongated shaft.

2. The side ring baton of claim 1 further comprising a light attached on said second bar of said finger fulcrum and facing posterior end of said elongated shaft.

3. The side ring baton of claim 1, wherein said elongated shaft has a length from about 5.5 inches to about 9.0 inches.

4. The side ring baton of claim 1, wherein said side ring has a diameter from about 1.1 inches to about 2.5 inches.

5. The side ring baton of claim 1, wherein a distance from a connection point of said side ring to said anterior end of said elongated shaft is from about 1.5 inches to about 2.5 inches.

6. The side ring baton of claim 1, wherein said elongated shaft is cylindrical.

7. The side ring baton of claim 1 further comprising a surface coating on one or more regions of said side ring baton selected from the group consisting of said side ring and said anterior end of said elongated shaft.

8. The side ring baton of claim 1 further comprising a pressure amplifying tip on said posterior end of said elongated shaft.

9. A side ring baton comprising:

(a) an elongated shaft having a closed anterior end, and a closed posterior end; wherein a portion of said elongated shaft near said posterior end bends toward an interior side of said elongated shaft;

(b) a side ring having a circular interior, tangentially connected to an exterior side of said elongated shaft near said anterior end, said side ring being fixed stationary in a horizontal plane with said elongated shaft; and (c) a finger fulcrum between said elongated shaft and said side ring.

10. The side ring baton of claim 9, wherein an angle between bent portion of said elongated shaft and a longitudinal axis of said shaft is from about 110 degree to about 130 degree.

* * * * *